United States Patent [19]

Asakawa

[11] Patent Number: 4,940,998

[45] Date of Patent: Jul. 10, 1990

[54] CARRIAGE FOR INK JET PRINTER

[75] Inventor: Stuart D. Asakawa, San Diego, Calif.

[73] Assignee: Hewlett-Packard Company, Palo Alto, Calif.

[21] Appl. No.: 333,364

[22] Filed: Apr. 4, 1989

[51] Int. Cl.[5] ..... B41V 2/05; B41V 2/21

[52] U.S. Cl. ..... 346/140 R; 346/139 R

[58] Field of Search ..... 346/140, 139 R

[56] References Cited

U.S. PATENT DOCUMENTS

| | | | |
|---|---|---|---|
| 4,500,895 | 2/1985 | Buck | 346/140 |
| 4,540,996 | 9/1985 | Saito | 346/140 |
| 4,554,556 | 11/1985 | Hirata | 346/140 X |
| 4,635,073 | 1/1987 | Hanson | 346/140 X |
| 4,812,859 | 3/1989 | Chan | 346/140 |
| 4,833,491 | 5/1989 | Rezanka | 346/140 |

FOREIGN PATENT DOCUMENTS 187865 10/1984 Japan .

*Primary Examiner*—Joseph W. Hartary

[57] ABSTRACT

A carriage (66) of an ink jet printer (60) mounts multiple print heads (10) in a non-colinear arrangement. Preferably, the carriage (66) provides four print head pockets (80) disposed at the corners of a rectangle, each of which pockets (80) receives one of the print heads (10). The print heads (10) are precisely located in the pockets (80), and two print heads (10) pass over alternating swaths of the printing medium during each traverse of the carriage (66). Each print head (10) ejects one or more colors in a pattern of dots during each pass.

5 Claims, 5 Drawing Sheets

CARRIAGE FOR INK JET PRINTER

BACKGROUND OF THE INVENTION

This invention relates to ink jet printers, and, more particularly, to the mounting arrangement of print heads in such printers.

Printers are devices that print characters onto a printing medium such as a sheet of paper or a polyester film. Printers of many types are available, and are commonly controlled by a computer that supplies the images, in the form of text or figures, that are to be printed.

Some printers use a colorant-containing liquid, which may be an ink or a dye, but is generally termed an "ink" in the printer industry, to form the images on the printing medium. (By contrast, other printers use a dry toner to form the image.) Such printers deliver the colorant to the medium using a print head that creates the proper patterning of colorant to permanently record the image.

One important type of printer is the thermal ink jet printer, which forms small droplets of ink that are ejected toward the printing medium in a pattern of dots that forms the images. When viewed at a distance, the collection of dots form the image in much the same manner that images are formed in newspapers. Ink jet printers are fast, produce high quality printing, and are quiet, because there is no mechanical impact during formation of the image, other than the droplets of colorant striking the printing medium.

Typically, an ink jet printer has a large number of individual colorant-ejection nozzles in a print head, supported in a carriage and oriented in a facing, but spaced-apart, relationship to the printing medium. The carriage and supported print head traverse over the surface of the medium, with the nozzles ejecting droplets of colorant, at appropriate times under command of the computer or other controller, to produce a swath of droplets. The droplets strike the medium and then dry to form "dots" that, when viewed together, form one swath or row of the permanently printed image. The carriage is moved an increment in the direction lateral to the traverse (or, alternatively, the printing medium is advanced), and the carriage again traverses the page with the print head operating to deposit another swath. In this manner, the entire pattern of dots that form the image is progressively deposited by the print head during a number of traverses of the page. To achieve the maximum output rate, the printing is preferably bidirectional, with the print head ejecting colorant during traverses from left-to-right and right-to-left.

Color ink jet printers utilize several, typically four, different print heads mounted in the print carriage to produce both primary and secondary colors. Each of the print heads produces a different color, with four often-used colors being cyan, yellow, black, and magenta. These primary colors are produced by depositing a droplet of the required color onto a dot location. Secondary or shaded colors are formed by depositing multiple droplets of different color inks onto the same dot location, with the overprinting of two or more primary colors producing secondary colors according to well established optical principles.

Good print quality is one of the most important considerations and bases of competition in the ink jet printer industry. Since the image is formed of thousands of individual dots, the quality of the image is ultimately dependent upon the quality of each dot, and the arrangement of the dots on the medium. Because of the fashion in which the printing occurs, the quality of the dots can have a surprisingly large effect upon the final image quality, both for black-and-white and color images. The present invention is directed toward improvement of the image by improvements in the quality of the printed dots in color images.

There can be several sources of degradation of the image in color printing, particularly for the bidirectional printing of secondary colors where each dot is produced by overprinting of two primary colors. There can be a perceived color shift due to the different appearance of a droplet of a first color deposited over a droplet of a second color, as compared with a droplet of the second color deposited over a droplet of a first color. That is, a color 1 on color 2 dot usually has a different shade or tint than a color 2 on a color 1 dot. Another shading problem arises when the first deposited droplet has not dried when the second droplet is deposited, causing an intermixing of colors on the medium that creates yet a third shade of color.

Other sources of reduced image quality arise from more mechanical origins. If the droplets from different print heads are not precisely superimposed when a secondary color is printed, causing an absence of registry, the resulting dot usually has regions of three different tints, one for each of the deposited primary colors and an overlap region of the desired secondary color. Mechanical alignment of the print heads to achieve and retain perfect superposition is difficult, for two reasons. One is that the dots are quite small, on the order of a few thousandths of an inch in diameter, and the tolerances on the print heads themselves and their alignment in the carriage are therefore very tight. Further, the print heads must sometimes be changed, as for example when the print head runs dry of colorant, by the user, a person typically not familiar with alignment procedures. The arrangement for supporting the print heads in the carriage must therefore be self-aligning to a high degree of accuracy, even when the alignment is conducted by an unskilled person. Misalignment of dots also arises from backlash of the printer traversing mechanism, and from a directionality effect when a dot is printed with the print head moving from left to right as compared with right to left. Yet another source of mechanical problems in forming the dots is that the relatively large amount of liquid deposited on one location can be absorbed by the printing medium in such a way that the medium becomes irregularly wavy in the vicinity of the dot when the ink dries, a condition known as "cockle".

Existing color ink jet printers produce images of acceptable quality, and are widely used. However, there is a continuing need for improved ink jet printers wherein the dots forming the images are of a reproducible, high quality that is retained in use in a wide variety of printing conditions, even when one or more of the print heads is changed by an unskilled person. The present invention fulfills this need, and further provides related advantages.

SUMMARY OF THE INVENTION

The present invention provides an approach for improving the quality of printed dots in ink jet printers having multiple print heads, such as color ink jet printers. Degradation of the dots due to color shifts, absence of registry, and cockle are reduced significantly. The "overtravel" required to permit all of the print heads to pass over the entire width of the page is reduced, permitting the printing of wider pages on a printer. Alternatively, the area occupied by the printer, its "footprint", may be reduced, so that the printer fits into a smaller available space.

In accordance with a preferred embodiment of the invention, a printing unit for an ink jet printer comprises means for supporting four print heads in a rectangular array. In conventional ink jet printers, the print heads are located in a single row, so that all four of the print heads traverse over a single swath of the printing medium in a single pass. The present approach preferably places the four print heads in a 2×2 rectangular array, so that two of the print heads pass over a particular swath of the printing medium in each traverse. The other two print heads of the array pass over the next-to-adjacent swath of the printing medium during the traverse, so that every other swath is being printed during each traverse. Since all four print heads are operable during each traverse, ink from each printing head can be deposited into all regions of the printing medium with successive traverses.

In the preferred embodiment the invention is used in relation to separate, removable print heads. In another embodiment, more than one colorant ejector may be mounted together. In accordance with this aspect of the invention, a printing unit for an ink jet printer comprises four colorant ejector plates disposed in a rectangular array.

More generally, the present invention is equally applicable to different numbers of printing heads used in a printer, and to different arrangements of the printing heads other than the preferred rectangular arrangement. In accordance with this aspect of the invention, a printing unit for an ink jet printer comprises a carriage having thereon support means for receiving and supporting at least two print heads that eject colorant of different colors onto a printing surface as the carriage moves relative to the printing surface in a traversing direction, at least some of the print heads being laterally displaced from each other relative to the traversing direction.

The placement of the print heads in a nonlinear arrangement permits secondary colors to be deposited with less incidence of color shifting. In an illustrative example, the four print heads deposit cyan, yellow, black, and magenta primary colorants. The cyan and yellow print heads are placed into one row, that covers the same swath on the printing medium, and the black and magenta print heads are placed into the other row. In bidirectional printing, the black print head operates first, followed by the magenta print head, during the traverse in the first direction over a particular swath of the printing medium. The printing medium then increments in position so that the yellow and cyan print heads can pass over the same swath printed previously by the black and magenta print heads. The yellow print head and the cyan print head operate in the reverse traverse of the print head over this swath. Thus, printing of a swath requires two traverses of the carriage, with black and magenta deposited on the first traverse over a particular swath of the printing medium, and yellow and cyan deposited on a later traverse. (During the later traverse, the black and magenta print heads usually deposit colorant on yet another swath, so that during any one traverse two swaths are being printed with different sets of colors.)

Color shifts of secondary colors are avoided for two of the three main secondary colors with this approach. Red is produced by depositing a yellow droplet and magenta droplet at the same dot location, and in the arrangement just described the magenta droplet is always deposited first. Blue is produced by depositing a magenta droplet and a cyan droplet, and in this arrangement the magenta droplet is always deposited first. There is no possibility of color shift in bidirectional printing of red and blue, with this arrangement of print heads. Green is produced by depositing a yellow droplet and a cyan droplet at the same dot location, and in this arrangement there can be a color shift in bidirectional printing because yellow would be deposited first for printing in one direction, and cyan would be deposited first for printing in the other direction. Thus, the present approach permits high speed, bidirectional printing while avoiding some, but not all, of the color shifting problems. Even color shifts of green dots can be avoided by implementation of other printing strategies, as will be described.

The absence of perfect registry of the droplets to produce each dot is reduced in the present arrangement. With prior linear carriages, thermal expansion and additive manufacturing tolerances typically caused the majority of the registry error that might be present. In a preferred embodiment, the print heads are supported in a support plate having four pockets disposed in a rectangular array, each pocket being adapted to receive a removable print head. Each of the four pockets includes a sufficient number of stops to prevent movement or shifting of the cartridge in the plane of the paper, and rotation of the cartridge. Thus, the four print heads are placed close together, minimizing thermal expansion effects that cause misregistry of dots. The four print heads are mechanically located from nearly the same point, as the term "located" is used in the manufacturing industry, reducing errors that otherwise result from the cumulation of tolerances.

The present approach also permits the width of the printer to be reduced, relative to the width required for a linear array of print heads. The minimum width of the printer is determined by the width of the paper to be printed, plus twice the total width of the print heads aligned along the traverse direction, to permit overtravel of the print heads so that all heads can cover the full width of the printing medium. In a conventional printer having four print heads, the minimum width is the paper width plus about eight times the width of a single print head (assuming all print heads have the same width). In the present approach, the minimum width of the printer is the paper width plus about four times the width of a single print head. Thus, the present printer may be made with its width reduced by about four times the width of a single print head, an important advantage in many situations where the user has available only limited desk space.

The present approach permits the printer to be operated with generally the same controller as previously developed for conventional printers, with some slight modifications of programming. However, no major new assemblies are required, and the cost of the printer is equal to or less than that of the conventional printer. Other features and advantages of the present invention will be apparent from the following more detailed description of the preferred embodiment, taken in conjunction with the accompanying drawings, which illustrate, by way of example, the principles of the invention.

DETAILED DESCRIPTION OF THE PREFERRED EMBODIMENT

Figure 1:
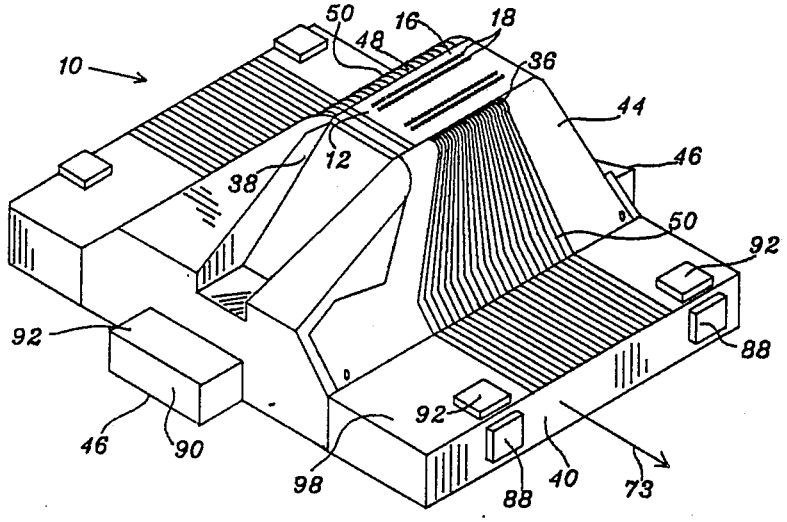
FIG. 1 is a perspective view of a thermal ink jet print head.
Figure 2:
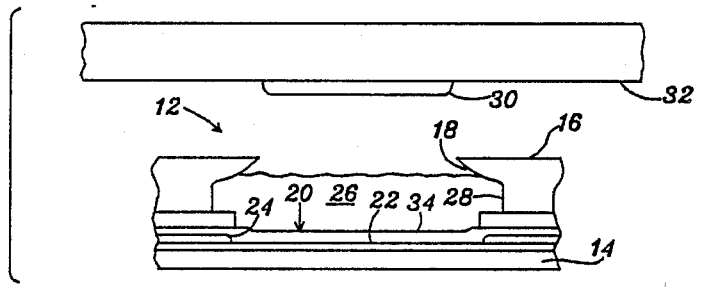
FIG. 2 is a schematic side view of an ejector.

The process of the present invention is preferably used in conjunction with a thermal ink jet printer, although it is not so restricted. A thermal ink jet printer utilizes a print head that creates and ejects microdroplets of colorant by vaporization of small bubbles of colorant. A thermal ink jet print head assembly 10, used to eject droplets of ink toward a print medium in a precisely controlled manner, is illustrated in FIGS. 1 and 2. Such a print head is discussed in more detail in U.S. Pat. No. 4,635,073, whose disclosure is incorporated by reference.

The print head 10 includes an ejector 12 having a silicon substrate 14 and a nozzle plate 16. The nozzle plate 16 has a plurality of nozzles 18 therein. Droplets of colorant are ejected from the individual nozzles 18. (As used herein, the term "colorant" means generally a fluid that is deposited upon a printing medium to produce images, which typically includes inks and dyes, and is not restricted in any narrow sense as may be found in the printing arts.)

Referring to the more detailed view of FIG. 2, droplets of colorant are ejected through the nozzles 18 by localized heating of the silicon substrate 14 with a heater 20. To effect such heating, the silicon substrate 14 has deposited thereon a plurality of tantalum-aluminum alloy planar resistors 22 with aluminum/copper and gold leads 24, one of the resistors being located adjacent each nozzle 18. An electrical current is passed through the portion of the resistor 22 between the ends of the leads 24, rapidly heating the resistor 22. A small volume of colorant adjacent the resistor 22 is thereby rapidly heated and vaporized, creating a bubble that causes some of the colorant 26 in a reservoir 28 to be ejected through the nozzle 18 to be deposited as a dot 30 on a printing medium 32 (such as paper or polyester). An optional passivation layer 34 overlies the resistor 22, to protect it from corrosion by the colorant and cavitation damage from the collapsing bubble.

Returning to FIG. 1, the ejector 12 is mounted in a recess 36 in the top of a central raised portion 38 of a plastic or metal manifold 40. The raised portion has slanted side walls 44. External electrical connection to the leads 24 and thence to the resistors 22 is supplied through a set of traces 48 on the silicon substrate 14, which connect to a flexible interconnect circuit 50, also sometimes known as a TABcircuit. The circuit 50 fits against the side walls 44, with one end extending to the traces 48 and the other end to external connections to the controllable current source that supplies current to the resistors 22. The general features, structure, and use of such flexible interconnect circuits 50, and their fabrication, are described in U.S. Pat. No. 3,689,991, whose disclosure is incorporated by reference.

Figure 3:
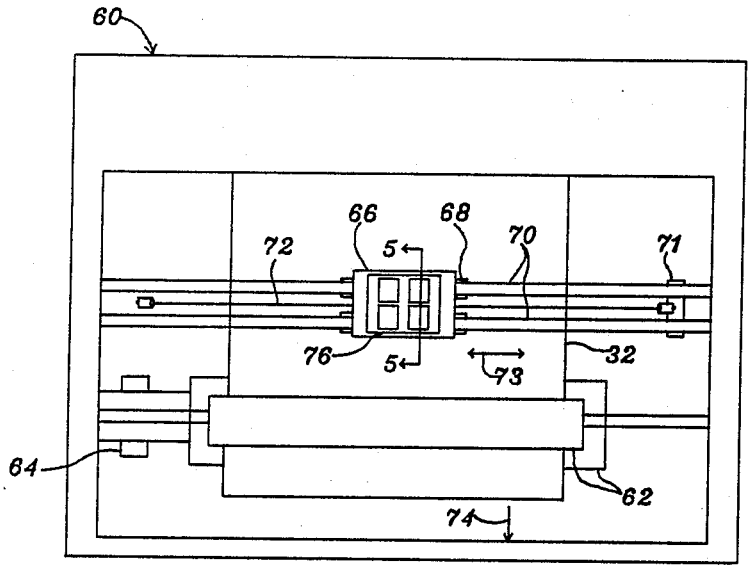
FIG. 3 is a plan view of a portion of an ink jet printer.

FIG. 3 illustrates a portion of one type of ink jet printer 60, which can utilize print heads of the type just discussed. The printer 60 includes a pair of facing platens 62 between which a sheet of the printing medium 32 is supported. One or both of the platens 62 are rotatably driven by a stepping motor or DC servo motor 64 that causes them to controllably rotate in either direction. Rotation of the platens 62 advances the printing medium in the selected direction.

Figure 4:
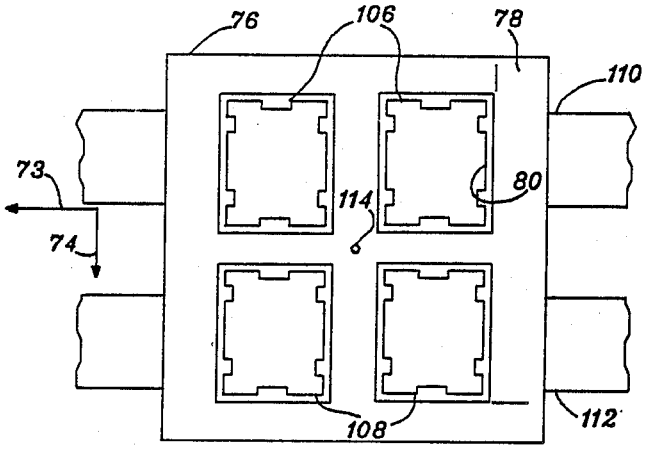
FIG. 4 is an enlargement of the carriage of the printer of FIG. 3, illustrating the presently preferred rectangular arrangement of four print heads.

A carriage 66, depicted in FIG. 3 and in greater detail in FIG. 4, is supported above the printing medium 32 on bearings 68 from a pair of rails 70. The carriage 66 slides along the rails 70 under the control of a traversing motor 71 acting through a belt or cable 72 that extends from the motor to the carriage 66. The direction of movement of the carriage 66 along the rail 70 is termed the "traversing direction", indicated by numeral 73. The traversing direction 73 is perpendicular to the direction of the advance of the printing medium through rotation of the platen 62, termed the "advance direction" and indicated by numeral 74.

Figure 5:
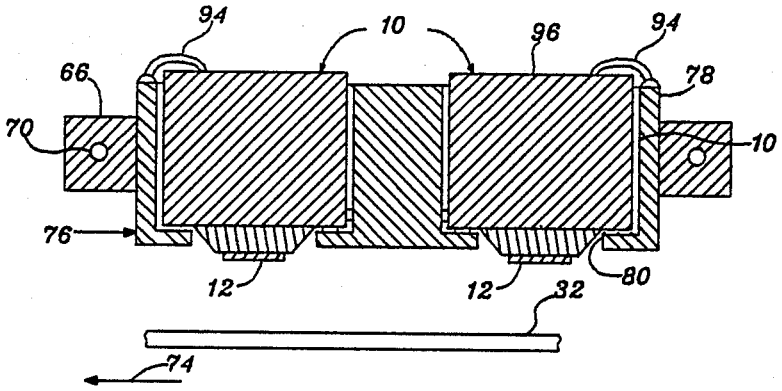
FIG. 5 is an enlarged side sectional view of the carriage of the printer of FIG. 3, taken along lines 5—5.

The print heads 10 are supported in the carriage 66, in a generally facing but spaced apart relationship to the printing medium 32, in the manner illustrated in FIG. 5, so that colorant droplets ejected from the ejector 12 strike the printing medium 32. Multiple print heads, or at least multiple ejectors 12, are needed where a variety of colors are to be printed. In the presently preferred practice, four print heads are supported in the carriage 66. Each of the print heads produces colorant droplets of only one color, or a total of four colors, which deposit upon the printing medium 32. However, the possible colors that may be printed are not restricted to those four primary colors. The superposition of droplets of colorant, or the formation of superpixels, can produce intermediate or secondary colors according to well established principles of color formation in reflection or transmission.

More specifically, in the preferred approach the four print heads deposit yellow, cyan, magenta, and black colorant onto the printing medium 32. Dots of these four primary colors are produced by depositing one droplet of the selected color. Dots of secondary colors are produced by depositing droplets of different primary colors overlying each other or adjacent each other. For example, a red dot is produced by depositing a droplet of yellow colorant over a droplet of magenta colorant at the same pixel location, in the case of overlying droplets, or several droplets can be deposited closely adjacent each other, in what is termed a superpixel.

Figure 6:
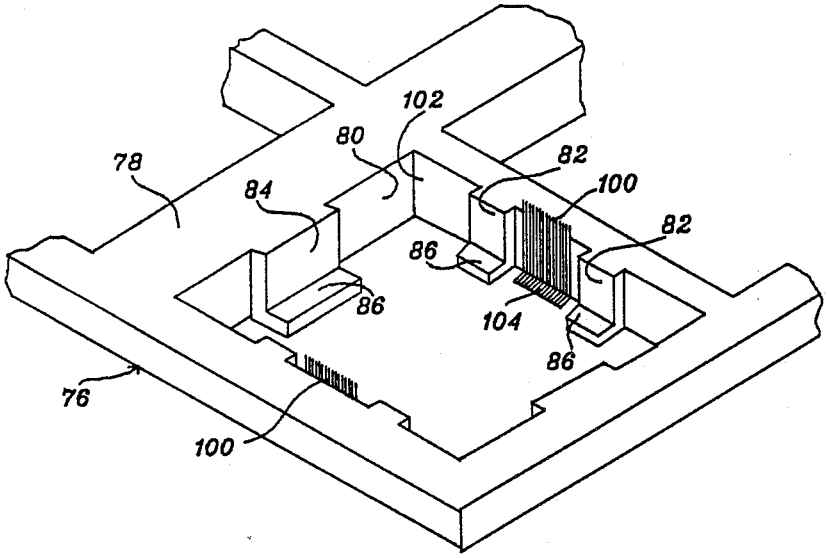
FIG. 6 is a perspective view of a portion of the print head support of FIG. 4.

The four print heads 10 are mounted in a support 76 on the carriage 66. As illustrated in various views in FIGS. 4–6, the support 76 preferably includes a body 78 and four pockets 80 therein. Each print head 10 slides into one of the pockets 80, and is supported therein on a set of stops that contact support pads on the print head. As illustrated in FIG. 6, the pocket 80 includes X-stops 82, Y-stops 84, and Z-stops 86. In the preferred approach, the stops 82, 84, and 86 are formed as angled brackets that extend outwardly from the sides of the pocket 80.

The print head 10 has thereon X-support surfaces 88, Y-support surfaces 90, and Z-support surfaces 92, see FIG. 1. The support surfaces 88, 90, and 92 are positioned on the print head 10 to contact and cooperate with the corresponding stops 82, 84, and 86, respectively, to support the print head 10 in the pocket 80 at the correct location and height for ejecting colorant onto the printing medium, in the manner illustrated in FIG. 5. The contact of the respective surfaces and stops also prevents rotation of the print head 10 about any axis. In short, the print head is held fixed in place by this approach.

The use of stops and support surfaces to position the print head 10 in the pocket 80 improves the accuracy and repeatability of the positioning. In general, when an active element (such as a print head) is mounted in a support structure, there can be a mispositioning of the mounted element due to the deviation of the supporting structure within its manufacturing tolerances. For a consumer product such as a printer, there is a prohibitively high cost of maintaining the entire print head 10 and support 76 within very tight dimension, orientation, and straightness tolerances to minimize mispositioning of the print head 10 and the resulting misregistry of overprinted dots 30 on the printing medium 32.

On the other hand, it is more feasible and less costly to require that only certain limited regions of each structure be maintained within the tight tolerances. In the present case, the position and orientation of the respective facing surfaces of the stops 82, 84, and 86, and the support surfaces 88, 90, and 92, can be more readily maintained within tight manufacturing tolerances so that the print head 10 is precisely positioned in the pocket 80, and so that the resulting printed dots are precisely positioned on the medium 32.

The precise positioning is achievable even by an untrained person who replaces the print head 10, because the replacement operation requires only that the print head 10 be inverted and then lowered into the pocket 80 so that the support surfaces contact their respective stops squarely. One or more clips 94 attached to the support 76 are then engaged to the exposed back surface 96 of the print head 10 to hold it solidly in place within the pocket 80.

This approach to positioning the print head 10 also permits the electrical connections to be readily made. When the print head 10 is in the inverted position as inserted into the pocket 80, the flexible interconnect circuit 50 faces downwardly. The conductors of the circuit 50 extend down the angled side walls 44 to a flat surface 98, which is horizontally and downwardly oriented when the print head 10 is in the inverted position. A corresponding external interconnect 100 extends down a side wall 102 of the pocket 80, and is directed into an outwardly extending shelf 104 so that the electrical traces of the interconnect 100 are horizontally but upwardly oriented. The traces of the two interconnect circuits 50 and 100 are therefore in an opposed facing relationship when the print head 10 is fully inserted into the pocket 80. The interconnect circuits 50 and 100 are designed with such a connection approach in mind, with corresponding traces positioned within the circuits 50 and 100 to permit this connection. The fastening of the clips 94 holds the electrical connections in a firm but releasable make/break contact, permitting easy disconnect when the print head is to be removed. The user of the printer therefore has no separate electrical connections to make.

FIG. 4 illustrates the preferred mounting arrangement of the present invention, a rectangular or 2×2 arrangement wherein a first pair of print heads 12, indicated by numeral 106, are side-by-side along the traversing direction 73, and a second pair of print heads 12, indicated by numeral 108, are also side-by-side along the traversing direction 73, but displaced from the first pair along the paper advance direction 74. This mounting arrangement is contrasted with the prior approach, wherein all four of the print heads are mounted in a linear arrangement along the traversing direction.

The region of the printing medium 32 over which the print heads pass, and upon which dots are printed, during any one traverse in the traversing direction 73, is termed a "swath". Progressive advancing of the paper in the advance direction 74 after swaths are printed results in coverage of the entire page of the printing medium 32 with the image to be printed.

In the prior linear arrangement of print heads, one swath is printed at a time with colorant being ejected onto the same swath from all of the print heads. This may lead to overprinting color shifts and paper cockle, as previously discussed.

In the present approach illustrated in FIG. 4, every other swath is printed during each pass of the print head. The first pair 106 of print heads and the second pair 108 of print heads are spaced apart by one swath width along the advance direction 74. The first pair 106 of print heads pass over a first swath 110 and the second pair 108 of print heads pass over a second swath 112 (which is spaced apart from the first swath 110 by one swath width) during a traverse of the carriage 66 in the traverse direction 73. After that traverse, the advance mechanism operates to advance the printing medium in the direction 74 by the width of one swath, so that the portion of the printing medium previously printed in the first swath moves to an intermediate position between the pairs 106 and 108 of print heads and is not printed upon during the next traverse. Following the next traverse, the advance mechanism again operates to move the printing medium another swath width so that the portion previously printed as the first swath 110 advances to the second swath position, and is printed upon by the second pair 108 of print heads during the next traverse of the carriage 66. The printing buffer memory is programmed to maintain the required printing pattern in order to permit this alternate swath printing approach. The printing of alternate swaths permits the colorant to dry, and also permits a better geometric patterning of the print heads 10. The use of the present invention is not limited to this printing strategy.

For the deposition of primary colors, this mode of printing has no effect on the colors deposited. For the deposition of secondary colors, where one droplet of primary color is deposited upon another droplet of primary color to form the secondary color, there is a significant reduction of both color shifts and dot registry mismatch.

Normally, the first pair of print heads 106 to print on a particular swath are the darker colors, magenta and black in the preferred approach. The second pair of print heads 108 to print on a particular swath are the lighter colors, yellow and cyan in the preferred approach. The darker colors are always deposited first, regardless of whether the traverse is from left to right or right to left. The darker colors are therefore always overprinted by the lighter colors from the second pair of print heads 108, even in bidirectional printing. By contrast, in the prior linear arrangement of print heads, there is no such priority in droplet deposition during bidirectional printing. Consequently, there are routine color shifts when a first color is deposited over a second color, as compared to the situation when the second color is deposited over the first color. Such color shift is particularly troublesome when one of the overprinted colors is a darker color and the other is a lighter color, and such color shifts are completely avoided in the present approach.

An example is useful in illustrating the formation of colors in the present approach. In the preferred approach, the first pair of print heads 106 include the black and magenta print heads, and the second pair of print heads 108 include the yellow and cyan print heads. The primary colors yellow, black, cyan, and magenta are printed with single droplets of the respective colors. The secondary colors are printed with two droplets. Red is printed as magenta overprinted by yellow, green is printed as yellow and cyan, and blue is printed as magenta overprinted by cyan. In this example, red and blue dots will never experience color shifts in bidirectional printing, because the magenta is always deposited first. There can be a color shift in the green dots during bidirectional printing, because both yellow and cyan print heads are mounted as a pair. During printing in one direction the green dot is formed as a yellow droplet deposited upon a cyan droplet, and during printing in the other direction the green dot is formed as a cyan droplet deposited upon a yellow droplet. However, the color shift for green is less than for other secondary colors, because the green color is composed of two lighter color droplets overdeposited one on the other. The upper droplet tends to be more transparent than if it were a dark color, resulting in a reduced visual impact of the color shift for green, as compared with the potential color shift for other secondary colors.

For check plots where perfect color precision is not required, such color shifts in only one of the colors may be acceptable. For final plots where perfect color is required, the printer can be programmed to print green only in one traversing direction to avoid any color shift at all, but such improvement in color perfection is at the expense of printing speed, because one additional pass of the print head over the printing medium is required for each swath having green dots.

Thus, in the present approach color shifts are avoided as between two of the three main secondary colors, a significant improvement over the prior approach of a linear array of print heads, where color shifts are found in all secondary colors during bidirectional printing. The print heads comprising the first and second pairs are chosen to minimize the apparent visual effect of the color shift of the one color where it is still present. In the example presented, the pairing and placement of the print heads completely avoids color shifts for red and blue, while permitting color shifts for green, where the color shift is expected to be less than for red and blue in any event. Different users of the printer may have different subjective judgments, and different arrangements of the print heads can be used. These judgements may sometimes be reached by the user on the basis of the aesthetics of the image. In other cases, some colors of an image may be dominant to the visual perception, and therefore the arrangement of print heads will be made to avoid color shifts in the dominant colors to the greatest extent possible. As noted, however, a slightly slower printing rate can be used to avoid color shifts entirely.

Color shifts are also reduced in the present approach by reducing the intermixing of liquid droplets. When the first droplet from the first pair of print heads 106 is deposited, it has time to dry and be absorbed into the printing medium before the second droplet from the second pair of print heads 108 is deposited thereover on the next traverse.

The overprinting of dots is mechanically more precise and less likely to be out of registry when the present rectangular configuration of print heads is used, as compared with a linear arrangement of print heads. As shown in FIG. 4, the positions of the four print heads are all precisely located only a short distance from a central locating point 114 at the center of the support 76. That is, when the support 76 is machined or otherwise formed, the positioning of the pockets 80 need be highly precise only in the region adjacent the locating point 114, in order for the respective nozzles 18 of the four print heads 10 to be precisely positioned. Using the previously described system of precisely positioned cooperating stops and support surfaces in combination with the central locating concept, highly accurate and reproducible positioning of the print heads 10 is achieved. By contrast, for a linear array of print heads, the entire length of the support must be very precisely fabricated so that the corresponding nozzles 18 are precisely aligned within the required print quality tolerances. Although tight manufacturing tolerances can be achieved with the linear array, requiring such tight tolerances significantly increases the cost of manufacture of the printer.

Another significant source of misregistry error is thermal expansion. If the printer is used at different temperatures, the print head support expands or contracts, causing relative movement of the print heads. The magnitude of the expansion is determined as the coefficient of thermal expansion of the material (assumed to be constant as between the prior approach and the present approach, as the same materials would be used for a fair comparison of the mechanical arrangements) times the initial distance between two points that are to be maintained a fixed distance apart to ensure registry of printed dots. In the present approach of a rectangular array, the distance between two points to be maintained in registry is between the stops of the four pockets, and is relatively small. In a linear array support, the distance for creation of a thermal expansion mismatch is much larger, being the distance between the furthest spaced pockets, resulting in a greater misregistry of the dots due to this source of error.

The support of the present invention is therefore inherently more easy to produce and to maintain in alignment during different conditions of use. The support 76 of the present invention may be made more economically and with a lighter weight, an important consideration because it is moved on the carriage.

The rectangular array of the preferred embodiment permits the width of the printer 60 to be reduced, while retaining the capability for full-width printing of a selected width of printing medium. In any printer, the body of the printer must be wider than the printing medium, so that there is an overtravel length for the print head to traverse past the end of the printing medium to ensure that the entire printing medium is printed. For a linear arrangement of four print heads, the overtravel length must be about eight times the width of each print head, while for a rectangular arrangement of four print heads, the overtravel length need only be about four times the width of each print head. Thus, the width of the "footprint" of the printer on a desk is narrower in the present approach than in the prior approach.

Figure 7:
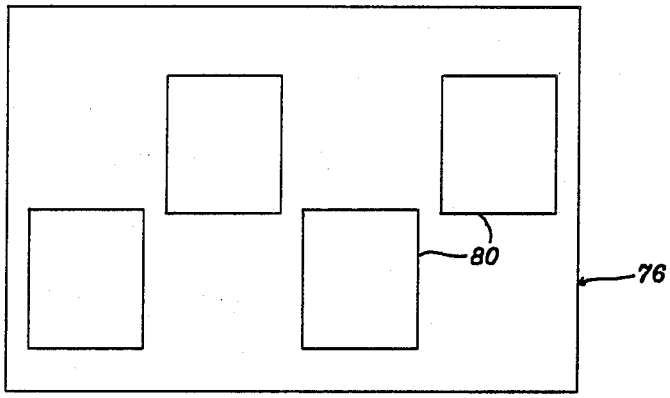
FIG. 7 is a schematic plan view of a support with pockets in a parallelogram arrangement.
Figure 8:
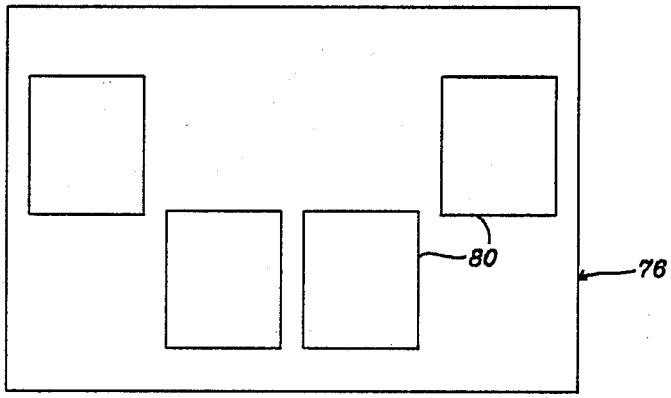
FIG. 8 is a schematic plan view of a support with pockets in a trapezoidal arrangement.

The preferred embodiment is directed toward a rectangular arrangement of print heads, when viewed in a plan view, as shown in FIG. 4. However, parallelogram (FIG. 7), trapezoid (FIG. 8), or other geometric arrangements are possible for particular requirements. Each arrangement has its own advantages. For example, with the rectangular arrangement of FIG. 4, it is difficult to place the swaths 110 and 112 exactly next to each other, and it is usually necessary to use a printing strategy wherein intermediate swaths are printed between the swaths 110 and 112, which is the presently preferred approach. With a trapezoidal or parallelogram arrangement of the print heads, the adjacent swaths could be printed next to each other more readily. The rectangular arrangement remains preferred, but the selection of other geometries may be made responsive to particular requirements.

The present invention thus provides a significant advance in the art of color ink jet printers through a rearrangement of the print heads. Although a particular embodiment of the invention has been described in detail for purposes of illustration, various modifications may be made without departing from the spirit and scope of the invention. Accordingly, the invention is not to be limited except as by the appended claims.

What is claimed is:

1. A printing unit for an ink jet printer, comprising:

means for supporting four print heads in a rectangular array, wherein the means for supporting includes a support plate having four pockets therein disposed in a rectangular array, each pocket being adapted to receive a removable print head, and wherein each of the four pockets includes at least three stops, two for preventing movement of the received print head in a direction lying in the plane of the rectangular array and the third for preventing movement of the received print head in a direction perpendicular to the plane of the rectangular array.

2. The printing unit of claim 1, wherein each pocket further includes means for establishing an electrical connection to a print head received in the pocket.

3. The printing unit of claim 1, further comprising four print heads mounted in the means for supporting.

4. The printing unit of claim 1, wherein the four print heads eject ink of different colors.

5. The printing unit of claim 1, wherein the print heads are thermal ink jet print heads.

* * * * *